United States Patent [19]

Rowley et al.

[11] 3,986,783

[45] Oct. 19, 1976

[54] ICE ROAD BUILDING METHOD AND MACHINE

[75] Inventors: Paul R. Rowley, Dallas, Tex.; Frank V. Love, Fairbanks, Alaska

[73] Assignee: Atlantic Richfield Company, Los Angeles, Calif.

[22] Filed: Aug. 24, 1972

[21] Appl. No.: 283,323

[52] U.S. Cl. ..... 404/95

[51] Int. Cl.[2] ..... E01C 23/14

[58] Field of Search ..... 404/77, 79, 95, 91, 404/72, 92, 101; 37/13, 12, 11, 10

[56] References Cited

UNITED STATES PATENTS

| | | | |
|---|---|---|---|
| 1,561,472 | 11/1925 | Linderman | 37/11 X |
| 2,069,376 | 2/1937 | Madsen | 404/92 |
| 2,185,179 | 1/1940 | Bird | 404/83 X |
| 2,351,593 | 6/1944 | Barber | 404/118 X |
| 2,394,017 | 2/1946 | Seaman | 404/95 |
| 3,259,123 | 7/1966 | Sangivanni | 37/12 X |
| 3,452,459 | 7/1969 | Campion | 37/12 |
| 3,455,041 | 7/1969 | Roberts | 37/12 X |
| 3,624,931 | 12/1971 | Wandscheer | 37/10 X |
| 3,732,023 | 5/1973 | Rank | 404/92 X |

FOREIGN PATENTS OR APPLICATIONS

| | | | |
|---|---|---|---|
| 118,518 | 6/1959 | U.S.S.R. | 37/13 |

*Primary Examiner*—Nile C. Byers, Jr.
*Attorney, Agent, or Firm*—Robert M. Betz

[57] ABSTRACT

A method and machine for constructing ice roads upon snow-covered regions. The machine gathers snow from the region upon which the road is to be built, heats the gathered snow until it is partially melted and becomes slush, and then spreads the slush to form the road. In one embodiment, the surface upon which the slush is deposited is pre-heated to enhance the road base.

3 Claims, 4 Drawing Figures

10
12
14
16
18
20
22
24
30

ICE ROAD BUILDING METHOD AND MACHINE

BACKGROUND OF THE INVENTION

1. Field of the Invention.

This invention relates to road building and particularly relates to the construction of ice roads and the like.

2. Description of the Prior Art.

In snowy regions, such as the arctic and the like, travel from one point to another creates unique problems not ordinarily encountered. For example, in the arctic, there are many exploratory locations to which temporary access is desired, but to which permanent roads would not be appropriate. In the past, temporary exploratory roads have been made of gravel or the like; however, such gravel roads are time-consuming to build and maintain, are costly, especially in light of their temporary nature, and may damage the tundra or area upon which they are built.

One solution which has been proposed is to construct such roads of ice. Presently, the ice roads are constructed with standard earth-moving equipment, which is used to gather snow and concentrate it in the middle of the proposed roadway. The snow is then leveled to the road width desired and compacted. Water is then applied, allowed to penetrate the snow, and refreeze. This process generally is repeated until a road base of desired thickness is formed. The resulting ice roads are suitable for supporting heavy equipment loads, and will thaw and melt away leaving the underlying tundra undisturbed.

Such ice roads, however, require numerous pieces of road construction equipment, such equipment being at a premium in arctic areas. Additionally, the present road construction method is relatively slow; only short spans usually can be constructed due to seasonal time limitations.

SUMMARY OF THE INVENTION

In light of the above, it is, therefore, an object of the invention to provide an apparatus and method for building ice roads.

It is another object of the invention to present an apparatus which may be in a single self-contained unit for building ice roads.

These and other objects, features, and advantages will become apparent to those skilled in the art from the following detailed description when read in conjunction with the appended claims and accompanying drawing.

The apparatus, in accordance with the invention, in its broad aspect, presents a machine for constructing ice roads upon snow-covered surfaces. The machine carries means for collecting snow from a snow-covered region adjacent the machine and a heater for converting the collected snow into slush. The machine also carries means for moving the collected snow between the collecting means and the heater, means for depositing the slush onto the surface along a route of the road, and means behind the depositing means for leveling and compacting the slush on the surface to form the desired ice road.

Additionally, a method for building an ice road over a snow-covered region is presented. The method, in its broad aspect, includes the steps of gathering snow from the snow-covered region, partially melting the gathered snow to produce slush, then applying the slush to a route of the road whereby it will refreeze to produce a smooth ice layer to form a road surface.

BRIEF DESCRIPTION OF THE DRAWING

The invention is illustrated in the accompanying drawing, wherein.

DESCRIPTION OF THE PREFERRED EMBODIMENTS

Figure 3:
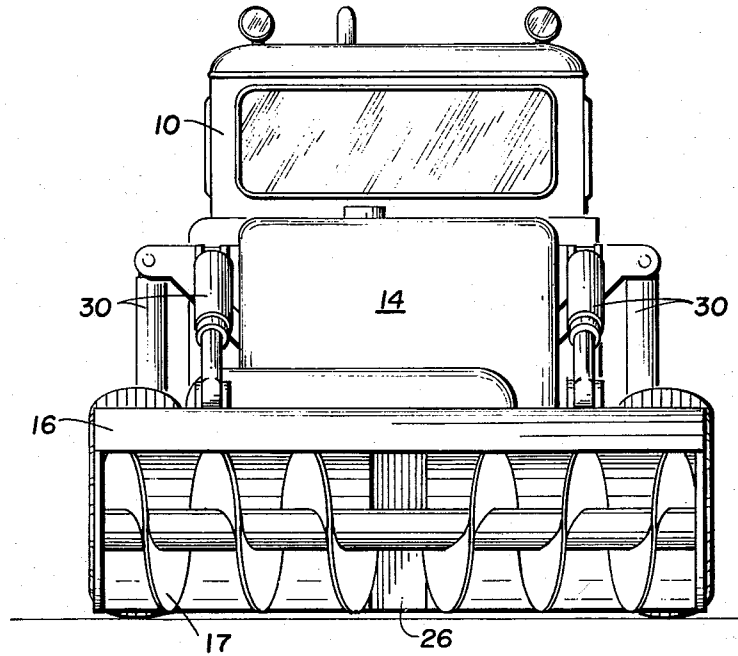
FIG. 3 is a front elevational view of the ice road building machine of the invention.
Figure 1:
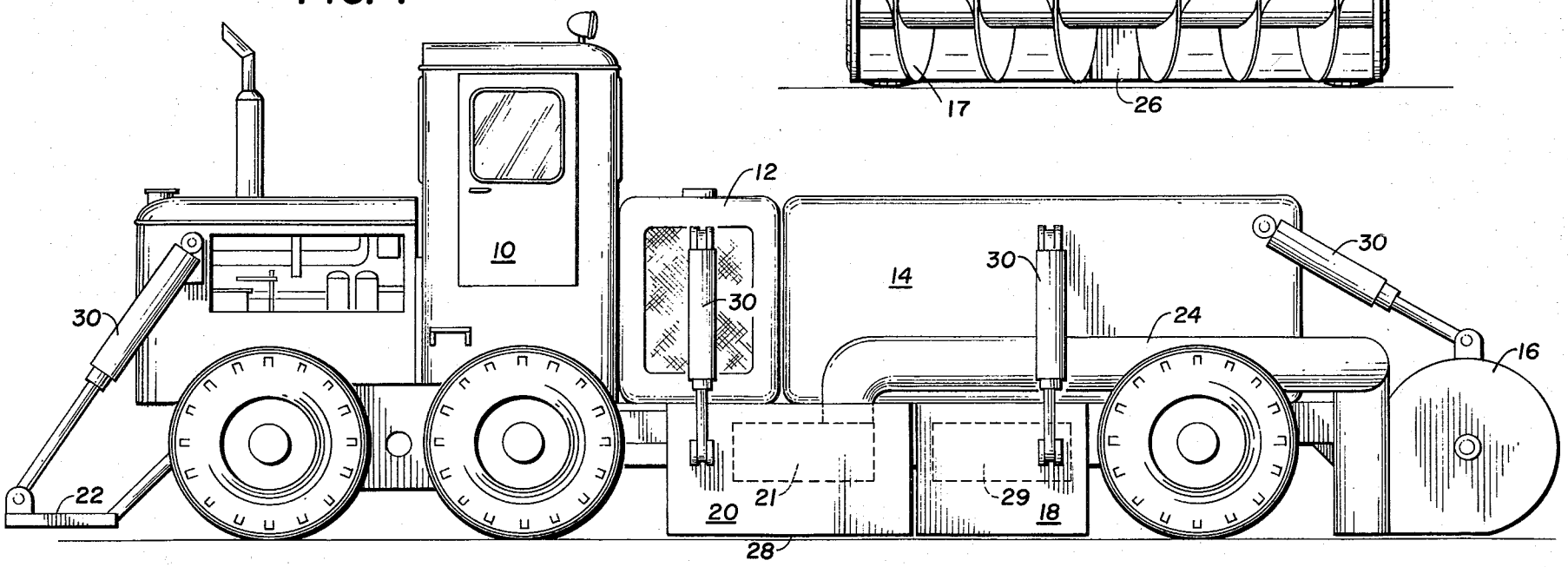
FIG. 1 is a side elevational view showing an ice road building machine, in accordance with the present invention.
Figures 2, 4:
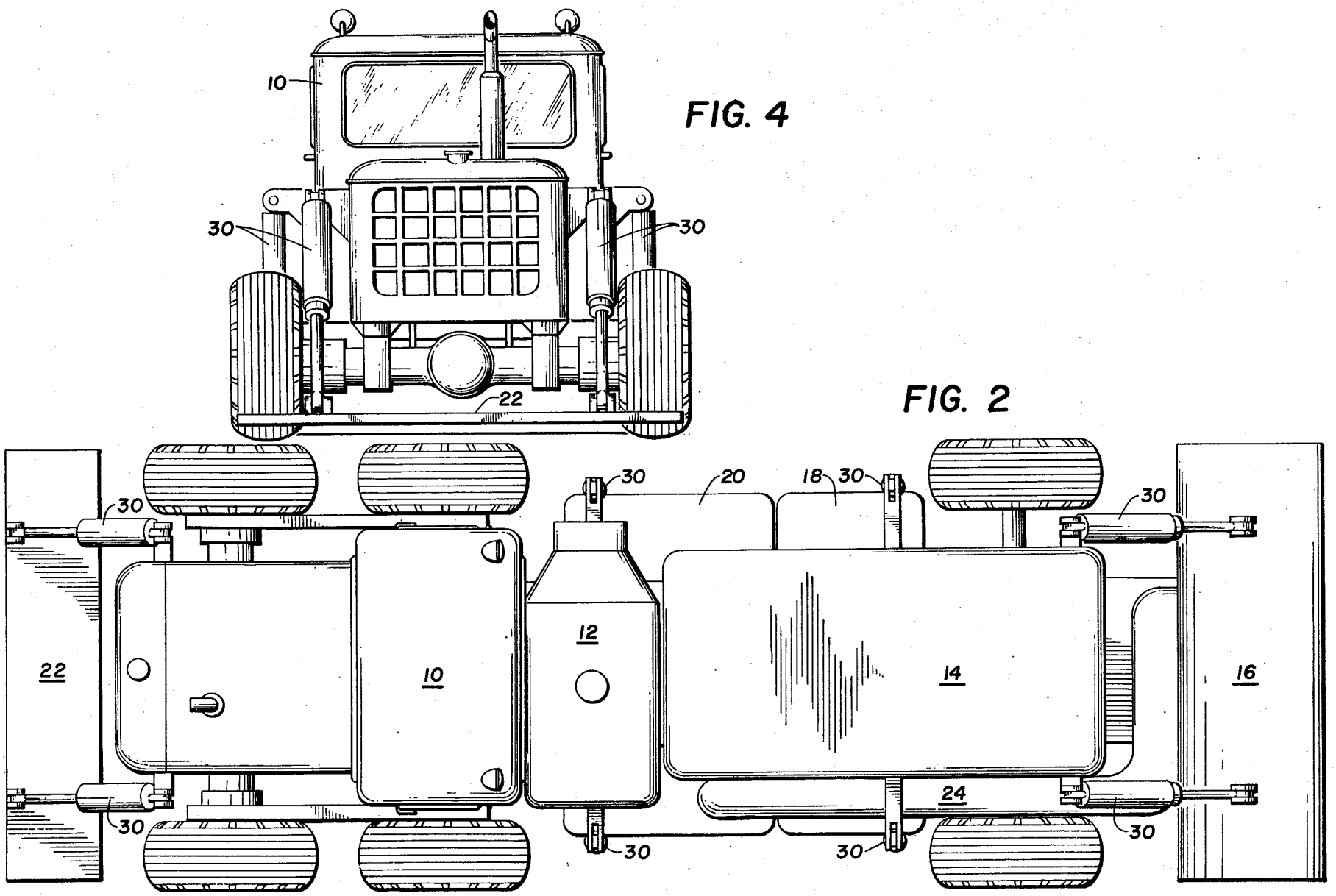
FIG. 2 is a top plan view of the ice road building machine, in accordance with the invention.
FIG. 4 is a rear elevational view of the ice road building machine, in accordance with the invention.

The ice road building machine, in accordance with a preferred embodiment of the invention, is illustrated in FIGS. 1–4. As shown, the overall machine includes a cab or drive control unit 10, a utility engine 12, and a fuel tank 14, all assembled as a unit. The machine may be either self-propelled (as shown), or it may be pulled by such as a tractor or the like. The unit may conveniently be carried upon wheels, as shown, or upon tracks, skis, skids, or other convenient supporting apparatus.

A means for collecting snow, such as a scoop 16, is carried near the front of the machine and is designed to gather snow from the proposed road surface. The scoop 16 may include an auger 17 or the like to direct the collected snow to within an aperture 26 (see FIG. 3) where it is blown by a blower 24 to a heater or heater section 20. If desired, scoops (not shown) may be included on the sides of the machine to supply additional quantities of snow from regions adjacent the machine and roadway, and, additionally to contribute to elevating the road above the surrounding grade to allow snow to be blown clear and minimize drifting across the roadway. Located within the heater section 20 to apply heat to the snow to convert it into slush (water mixed with snow) are combustion heaters 21, fired, for example, by gas or diesel fuel atomized by compressed air and taken to complete combustion in an excess of air supplied by forced air blowers (not shown). Complete conversion of the snow to water generally is not necessary. The slush is then released from the heater section 20 through its open bottom 28 onto the prepared road surface.

A roadway pre-heater section 18 is carried by the machine immediately forward of the heater section 20 and contains heaters 29 designed to heat the surface to which the slush is to be applied to enhance its condition to receive the slush from the heater section 20. A means for leveling and compacting the snow, such as the spreader bar 22, illustrated, then engages the slush to produce an even road surface.

The spreader bar 22 may include one or more heating elements to assist the spreading of the slush and forming of a smooth surface. The heating elements (not shown) may be direct burners directed onto the spreader, or, alternatively, may be electrical heating elements contained within or directly upon the spreader bar.

Hydraulic cylinders 30, which may be independently controlled from within the cab 10, are provided to raise and lower the gathering scoop 16, the heater section 20, the roadway pre-heater section 18, and the spreader bar 22. Thus, by independently actuating the hydraulic cylinders 30, adjustments may be made to compensate for any unevenness in the roadbed. Additionally, holes or uneven places may be filled in by controlling the speed of the machine so that a greater slush deposit is made in lower places.

The utility engine 12 is used to provide hydraulic and electrical energy for operating the hydraulic cylinders 30, the blower 24, and for atomizing air compressors and combustion air blowers for the heater section 20, the roadway pre-heater section 18, the burners or heating elements of the spreader bar 22, and other power-driven elements of the machine. Diesel fuel for the cab 10 and the heater section 20 and the roadway pre-heater section 18 is provided by the fuel tank 14.

In operation, the machine is moved along the route of the road to be built, and snow from the route in the path of the machine is gathered into the scoop 16. The snow within the scoop 16 is then directed to the aperture 26 and blown by the blower 24 to the heater section 20. While the snow is being converted into slush within the heater section 20, the roadway pre-heater section 18 applies heat directly to the road surface. As the machine proceeds, slush formed in the heater section 20 is then discharged through its open bottom 28, and subsequently spread by the spreader bar 22 and leveled and compacted thereby to form an even road surface when it refreezes.

If second or subsequent layers of ice are required, new snow may be piled onto the road surface and the machine run over the road to apply additional ice laminations. The process may be repeated as many times as necessary to achieve the desired thickness and strength of the ice road.

The thickness of each layer deposited will, of course, be dependent upon the speed of the machine, the density of the snow, and the degree to which the snow is melted in the slush. It has been found, for example, that upon the North Slope in Alaska, one foot of snow produces approximately four inches of water. Thus, to achieve a roadbed of five- or six-inch thickness, two passes over the surface may be necessary, if sufficient snow is available to produce the required quantity of ice.

Although the invention has been described and illustrated with a certain degree of particularity, it is understood that the present disclosure is made by way of example only, and that numerous changes and modifications in the details of construction may be resorted to without departing from the spirit and scope of the invention as hereinafter claimed.

What is claimed is:

1. A machine for constructing ice roads comprising:
means carried upon the machine for collecting snow from a snow-covered region adjacent the machine,
a heater carried upon the machine for converting the collected snow into slush for redeposition onto a surface along a route of the road,
means for moving the collected snow between said collecting means and said heater,
means carried by the machine behind said heater for leveling and compacting the slush on the surface responsive to the forward motion of the machine to thereby form an ice road upon said surface, and
a roadway pre-heater carried by the machine forwardly from said means for leveling and compacting to heat the surface in preparation for deposit of the slush.

2. A method for building an ice road comprising:
gathering snow,
partially melting the gathered snow to produce slush,
preheating the route of the road, and
thereafter applying the slush to said route, whereby the slush will refreeze to produce a smooth ice layer to form a road surface.

3. The method of claim 2 further comprising the steps of smoothing and leveling the applied slush and reheating the applied slush simultaneously with the smoothing and leveling thereof.

* * * * *